US011366403B2

(12) United States Patent
Ota et al.

(10) Patent No.: US 11,366,403 B2
(45) Date of Patent: Jun. 21, 2022

(54) IMAGE FORMING APPARATUS CAPABLE OF SUPPRESSING A WHITE VOID IN AN IMAGE AND A CLEANING FAILURE IN A NON-MAGNETIC ONE COMPONENT DEVELOPMENT DEVICE

(71) Applicant: KYOCERA Document Solutions Inc., Osaka (JP)

(72) Inventors: Yukari Ota, Osaka (JP); Masahito Ishino, Osaka (JP); Takahisa Nakaue, Osaka (JP); Tomohiro Tamaki, Osaka (JP); Kotatsu Kawaguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/486,111

(22) Filed: Sep. 27, 2021

(65) Prior Publication Data

US 2022/0107580 A1 Apr. 7, 2022

(30) Foreign Application Priority Data

Oct. 2, 2020 (JP) ..... JP2020-167481

(51) Int. Cl.
*G03G 15/02* (2006.01)
*G03G 15/08* (2006.01)
*G03G 15/06* (2006.01)

(52) U.S. Cl.
CPC ..... *G03G 15/0291* (2013.01); *G03G 15/0266* (2013.01); *G03G 15/065* (2013.01); *G03G 15/0818* (2013.01)

(58) Field of Classification Search
CPC ..... G03G 15/0266; G03G 15/065; G03G 15/0813
USPC ..... 399/50, 55, 285
See application file for complete search history.

(56) References Cited

U.S. PATENT DOCUMENTS

| | | | | |
|---|---|---|---|---|
| 6,295,437 | B1 | 9/2001 | Hodoshima et al. | |
| 7,869,742 | B2 | 1/2011 | Igarashi et al. | |
| 2022/0050401 | A1* | 2/2022 | Ishino et al. ..... | G03G 15/0808 |
| 2022/0107584 | A1* | 4/2022 | Tamaki et al. ..... | G03G 15/065 |

FOREIGN PATENT DOCUMENTS

| | | | |
|---|---|---|---|
| JP | 2000-194192 | A | 7/2000 |
| JP | 2007-199652 | A | 8/2007 |

* cited by examiner

*Primary Examiner* — William J Royer
(74) *Attorney, Agent, or Firm* — Studebaker & Brackett PC

(57) ABSTRACT

An image forming apparatus includes an image carrier, a charger, an exposure device, a development device and a pressing mechanism. When a developer carrier and the image carrier are rotated in a state where a film is held in a development nip area and then a pulling force of the film is measured, a maximum value MAX, a minimum value MIN, and an average value X of the pulling force satisfy the expressions (1) and (2). When a development voltage applied to the developer carrier is set to Vdc, the surface potential of the image carrier is set to V0, and the surface potential of the image carrier after exposure is set to VL, the expressions (3) and (4) are satisfied.

$$X \leq MAX \leq 1.5X \quad (1),$$

$$0.5X \leq MIN \leq X \quad (2),$$

$$V0 - Vdc \geq 2(Vdc - VL) \quad (3) \text{ and}$$

$$Vdc - VL \geq 100 \quad (4).$$

10 Claims, 8 Drawing Sheets

IMAGE FORMING APPARATUS CAPABLE OF SUPPRESSING A WHITE VOID IN AN IMAGE AND A CLEANING FAILURE IN A NON-MAGNETIC ONE COMPONENT DEVELOPMENT DEVICE

INCORPORATION BY REFERENCE

This application is based on and claims the benefit of priority from Japanese patent application No. 2020-167481 filed on Oct. 2, 2020, which is incorporated by reference in its entirety.

BACKGROUND

The present disclosure relates to an image forming apparatus using an electrophotographic process, such as a copy machine, a printer and a facsimile, and more particularly, to an image forming apparatus provided with a non-magnetic one-component development type development device.

As the development device used in the image forming apparatus using the electrophotographic process, such as a copy machine, a printer, a facsimile and a multifunctional peripheral, a two-component development type employing a toner and a carrier as a developer and a one-component development type employing a toner only without using a carrier are known.

In the development device of the non-magnetic one-component development type, the toner is conveyed by fine concave and convex formed on a surface of a development roller, and excessive toner is regulated by a regulating blade to form a toner thin layer. In addition, when the toner passes below the regulating blade, the toner is charged by friction with the surface of the development roller. Then, a photosensitive drum is rotated with coming into contact with the development roller, and the toner on the surface of the development roller is supplied to the photosensitive drum by electric field.

The non-magnetic one-component development type eliminates the need of devices such as a magnet, a metal sleeve and the carrier, which are necessary for the two-component development type, and allows to perform a sufficient development using only a DC voltage. That is, a stable development performance can be obtained with a simple and low-cost configuration, so that the non-magnetic one-component development type is positively adopted for a low-speed compact machine mainly.

In the above-described non-magnetic one-component development type, a toner produced by pulverization method is disadvantageous in a system where the toner remaining after transferred is removed by development electric field because of its low circularity. However, by setting the development electric field advantageous to cleaning, it becomes possible to secure a cleaning performance.

In the case, if a pressing force between the development roller and the photosensitive drum is higher than a specified value, a collection electric field is excessively applied, and one dot is reduced or lacked, and a white void in which a density of the half image is lowered occurs in the image. Conversely, when the pressing force is lower than the specified value, an air gap is generated between the development roller and the photosensitive drum, and a cleaning failure occurs. That is, it is important to maintain the pressing force between the development roller and the photosensitive drum within a certain range.

Then, a method for maintaining a suitable pressing state of a developer carrier on an image carrier is proposed. For example, there is a development device provided with a plurality of elastic members as a pressing means for pressing the developer carrier to the image carrier. The elastic members apply a pressing force or a pulling force on a unit at a plurality of positions and press the developer carrier to the image carrier. Further, there is a development cartridge provided with an elastic member and a pressing member. The elastic member is provided at the other end portion on an opposite side to a developer carrier supporting part and biases the developer carrier toward the image carrier, and the pressing member is provided at the other end portion and transmits a pressing force input from the outside to the elastic member.

A proper value of the pressing force between the development roller and the photosensitive drum varies depending on a state of the toner. For example, it has been known from experiments that after durable printing in a low temperature and low humidity environment (a L/L environment), the proper range of the pressing force is reduced due to toner degradation. Furthermore, the pressing force between the development roller and the photosensitive drum itself varies depending on external temperature and humidity, and change in the dimension of the member due to durability. Therefore, even if the above-described structure is used, there is a possibility that the white void in the image and the cleaning failure occur due to environmental variation or durability.

SUMMARY

In accordance with an aspect of the present disclosure, an image forming apparatus includes an image carrier, a charger, an exposure device, a development device and a pressing mechanism. The image carrier is rotatable, and has a surface on which a photosensitive layer is formed. The charger charges the image carrier at a predetermined surface potential. The exposure device exposes the surface of the image carrier charged by the charger and attenuates the surface potential to form an electrostatic latent image. The development device includes a development container, a developer carrier and a regulating blade. The development container contains a non-magnetic one-component developer consisting of a toner only. The developer carrier includes a roller part which carries the toner on an outer circumferential surface and a rotational shaft disposed along an axial center of the roller part, and is pressed on the image carrier with a predetermined pressing force to form a nip area between the roller part and the image carrier. The regulating blade comes into contact with the outer circumferential surface of the roller part of the developer carrier to regulate a thickness of a toner layer formed on the outer circumferential surface of the roller part. The development device is configured to supply the toner to the image carrier on which the electrostatic latent image is formed. The pressing mechanism presses the development container close to the image carrier. When the developer carrier and the image carrier are rotated in a state where a polyethylene terephthalate film having a width of 20 mm and a thickness of 50 μm is held in the nip area and then a pulling force of the film is measured at a plurality of positions in an axial direction of the nip area on an upstream side of the nip area in a rotational direction of the image carrier, a maximum value MAX of the pulling force, a minimum value MIN of the pulling force, and an average value X=(MAX−MIN)/2 of the pulling force satisfy the following expressions (1) and (2). When a development voltage applied to the developer carrier is set to Vdc, the surface potential of the image carrier is set to V0, and the surface potential of the image carrier after exposure is set to VL, the following expressions (3) and (4) are satisfied.

$$X \leq MAX \leq 1.5X \quad (1),$$

$$0.5X \leq MIN \leq X \quad (2),$$

$$V0 - Vdc \geq 2(Vdc - VL) \quad (3) \text{ and}$$

$$Vdc - VL \geq 100 \quad (4).$$

The other features and advantages of the present disclosure will become more apparent from the following description. In the detailed description, reference is made to the accompanying drawings, and preferred embodiments of the present disclosure are shown by way of example in the accompanying drawings.

BRIEF DESCRIPTION OF THE DRAWINGS

DETAILED DESCRIPTION (1. Entire Structure of Image Forming Apparatus 1) Hereinafter, with reference to the attached drawings, one embodiment in the present disclosure will be described. FIG. 1 is a sectional side view schematically showing a structure of an image forming apparatus 1 according to the embodiment of the present disclosure. The right side in FIG. 1 is defined as a front side of the image forming apparatus 1 and the left side in FIG. 1 is defined as a rear side of the image forming apparatus 1.

Figure 1:
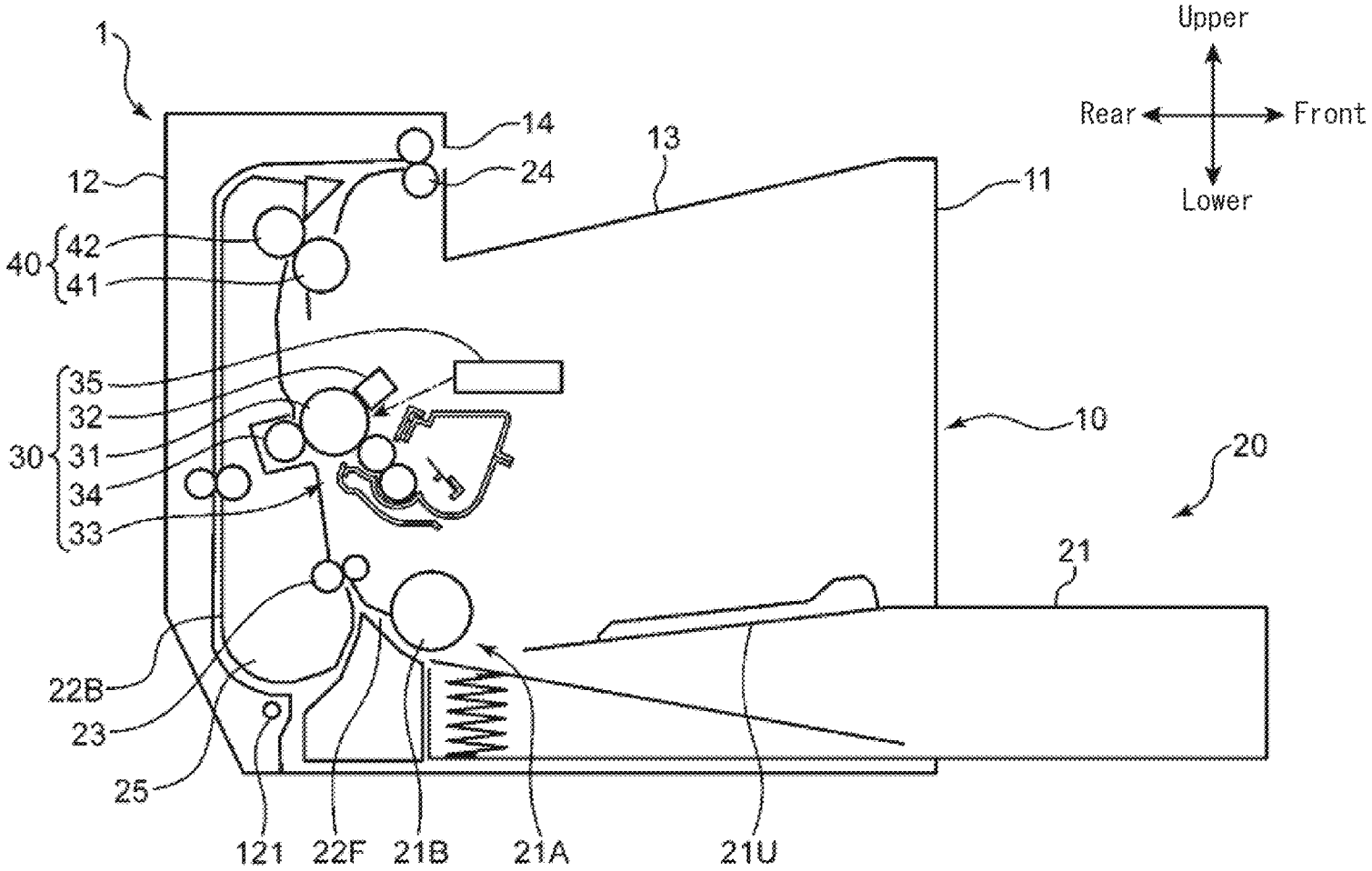
FIG. 1 is a side sectional view schematically showing a structure of an image forming apparatus 1 according to one embodiment of the present disclosure.

The image forming apparatus 1 (a monochrome printer, in this embodiment) includes a main body housing 10 having a housing structure of a substantially rectangular parallelepiped shape, a sheet feeding part 20, an image forming part 30, and a fixing part 40 which are housed in the main body housing 10. A front cover 11 is provided on the front surface of the main body housing 10, and a rear cover 12 is provided on the rear surface of the main body housing 10. Each unit of the image forming part 30 and the fixing part 40 can be attached to and detached from the rear surface side of the main body housing 10 by opening the rear cover 12. On the upper surface of the main body housing 10, a sheet discharge part 13 which discharges the image formed sheet is provided. In the following description, the term "sheet" refers to a copy paper, a coated paper, an OHP sheet, a thick paper, a postcard, a tracing paper, and other sheet materials on which an image forming processing is performed.

The sheet feeding part 20 includes a sheet feeding cassette 21 in which the sheet on which the image forming processing is to be performed is stored. A part of the sheet feeding cassette 21 protrudes further forward from the front surface of the main body housing 10. The upper surface of the sheet feed cassette 21 housed in the main body housing 10 is covered with a sheet feeding cassette top plate 21U. The sheet feeding cassette 21 is provided with a sheet storage space in which a bundle of the sheets is stored, a lift plate which lifts up the bundle of sheets and feeds it, and the others. Above the rear end portion of the sheet feeding cassette 21, a sheet feeding part 21A is provided. In the sheet feeding part 21A, a sheet feeding roller 21B which feeds the uppermost sheet of the bundle of sheets in the sheet feeding cassette 21 one by one is disposed.

The image forming part 30 performs the image forming processing which forms a toner image (a developer image) on the sheet fed from the sheet feeding part 20. The image forming part 30 includes a photosensitive drum 31, a charger 32, an exposure part 35, a development part 33 and a transfer roller 34 which are disposed around the photosensitive drum 31.

The photosensitive drum 31 (an image carrier) includes a rotational shaft and an outer circumferential surface (a drum body) rotating around the rotational shaft. The photosensitive drum 21 is made by, for example, a known organic photosensitive member (OPC), and around the outer circumferential surface of the photosensitive drum 31, a photosensitive layer including a charge generating layer, a charge transporting layer, and the others is formed. The photosensitive layer is uniformly charged by the charger 32 described later, and then is irradiated with light by the exposure part 35 to attenuate the surface potential and to form an electrostatic latent image. Then, on the photosensitive layer, a toner image in which the electrostatic latent image is developed by the development part 33 is carried.

Figure 2:
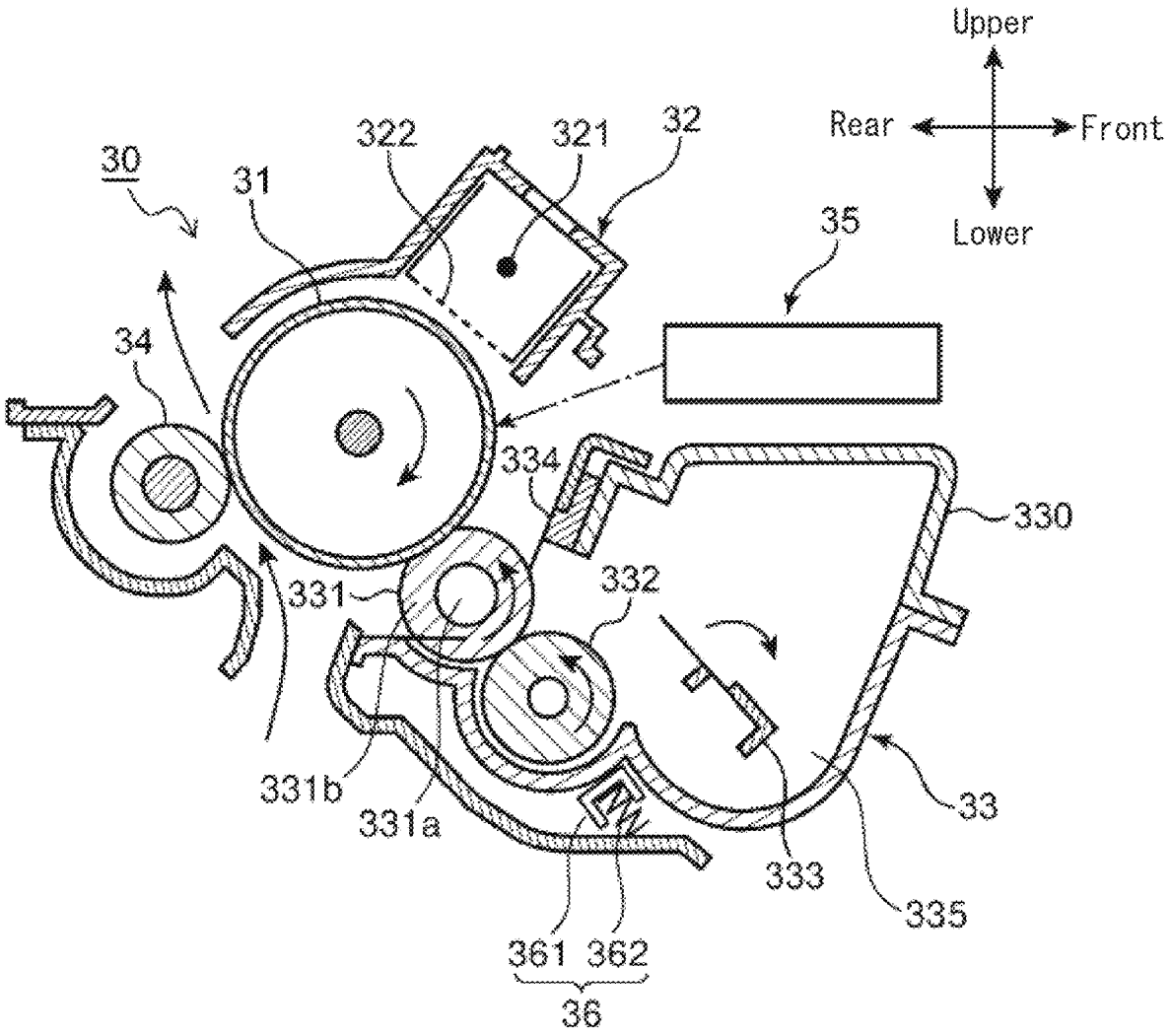
FIG. 2 is a side sectional view schematically showing a structure of an image forming part 30 of the image forming apparatus 1 according to the present embodiment.

The charger 32 (a charging device) is disposed at a predetermined interval with respect to the outer circumferential surface of the photosensitive drum 31, and uniformly charges the outer circumferential surface of the photosensitive drum 31 in a non-contact state. Specifically, the charger 32 includes a charge wire 321 and a grid electrode 322 (both are shown in FIG. 2). The charge wire 321 is a linear electrode extending in the rotational axis direction of the photosensitive drum 31, and generates corona discharge between the charge wire 321 and the photosensitive drum 31. The grid electrode 322 is a grid-like electrode extending in the rotational axis direction of the photosensitive drum 31, and is disposed between the charge wire 321 and the photosensitive drum 31. The charger 32 generates the corona discharge by flowing a current of a predetermined current value through the charge wire 321, and charges the outer circumferential surface of the photosensitive drum 31 facing the grid electrode 322 to a predetermined surface potential uniformly by applying a predetermined voltage to the grid electrode 322.

The exposure part 35 (an exposure device) includes a laser light source and optical elements such as a mirror and a lens, and irradiates the light modulated based on image data output from an external device, such as a personal computer, on the outer circumferential surface of the photosensitive drum 31. Then, the exposure part 35 forms the electrostatic latent image corresponding to an image based on the image data on the outer circumferential surface of the photosensitive drum 31.

The development part 33 (the development device) is attachable to and detachable from the main body housing 10, and supplies a non-magnetic one-component toner (a developer) to the outer circumferential surface of the photosensitive drum 31 to develop the electrostatic latent image formed on the outer circumferential surface of the photosensitive drum 31. The developing the electrostatic latent image means that a toner image (a developer image) in which the electrostatic latent image is made visible is formed. The development part 33 will be described later in detail.

The transfer roller 34 is a roller which transfers the toner image formed on the outer circumferential surface of the photosensitive drum 31 to the sheet. Specifically, the transfer roller 34 has an outer circumferential surface rotating around an axis and facing the outer circumferential surface of the photosensitive drum 31 on the downstream side of a development roller 331 in the rotational direction of the photosensitive drum 31. The transfer roller 34 transfers the toner image carried on the outer circumferential surface of the photosensitive drum 31 to the sheet passed through a nip area between the transfer roller 34 and the outer circumferential surface of the photosensitive drum 31. At the transferring, the transfer roller 34 is applied with a transfer voltage having a polarity opposite to the toner.

The fixing part 40 performs a fixing processing in which the toner image transferred to the sheet is fixed on the sheet. The fixing part 40 includes a fixing roller 41 and a pressure roller 42. The fixing roller 41 includes a heat source housed therein, and heats the toner transferred to the sheet at a predetermined temperature. The pressure roller 42 is brought into pressure contact with the fixing roller 41 to form a fixing nip area between the fixing roller 41 and the pressure roller 42. When the sheet to which the toner image is transferred is passed through the fixing nip area, the toner image is heated by the fixing roller 41 and pressed by the pressure roller 42 to be fixed on the sheet.

Inside the main body housing 10, a main conveyance path 22F and an inversion conveyance path 22B along which the sheet is conveyed are provided. The main conveyance path 22F extends from the sheet feeding part 21A of the sheet feeding part 20 to a sheet discharge port 14 provided facing the sheet discharge part 13 provided on the upper surface of the main body housing 10 via the image forming part 30 and the fixing part 40. The inversion conveyance path 22B is a conveyance path for returning the sheet formed with the image on one surface to the upstream side of the image forming part 30 on the main conveyance path 22F when the both-side printing is performed on the sheet.

The main conveyance path 22F is extended such that the sheet is conveyed through the transfer nip area between the photosensitive drum 31 and the transfer roller 34 from the lower side to the upper side. On the main conveyance path 22F, a registration rollers pair 23 is disposed on the upstream side of the transfer nip area. The sheet is stopped by the registration rollers pair 23, and then fed to the transfer nip area at a predetermined timing for the image transferring after the skew of the sheet is corrected. At suitable positions on the main conveyance path 22F and the inversion conveyance path 22B, a plurality of conveyance rollers for conveying the sheet is disposed. Near the sheet discharge port 14, a discharge rollers pair 24 is disposed.

The inversion conveyance path 22B is formed between the outer surface of an inversion unit 25 and the inner surface of the rear cover 12 of the main body housing 10. On the inner surface of the inversion unit 25, the transfer roller 34 and one roller of the registration rollers pair 23 are mounted. The rear cover 12 and the inversion unit 25 are rotatable around a supporting point 121 provided in the lower portions thereof. When the sheet jamming occurs on the inversion conveyance path 22B, the rear cover 12 is opened. When the sheet jamming occurs on the main conveyance path 22F, or when the unit of the photosensitive drum 31 or the development part 33 is detached outside, the inversion unit 25 is opened together with the rear cover 12.

Figure 3:
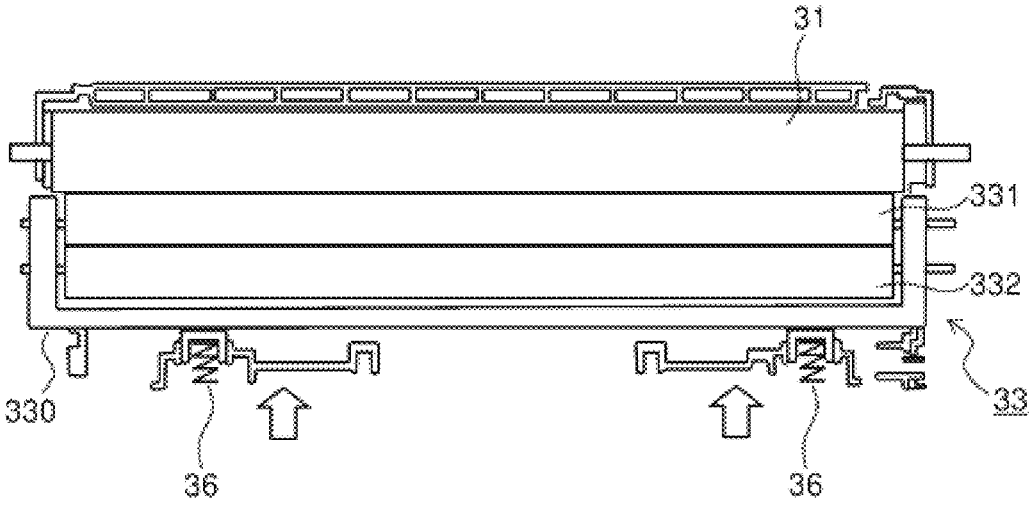
FIG. 3 is a plan view showing a contact area between a photosensitive drum 31 and a development roller 331 of a development part 33 viewed from the upper side.

(2. Structure of Image forming Part 30) FIG. 2 is a sectional view showing the image forming part 30 in the image forming apparatus 1 of the present embodiment. FIG. 3 is a plan view showing a contact area between the photosensitive drum 31 and the development roller 331 of the development part 33 viewed from the upper side. FIG. 3 is an enlarged sectional view showing a contact area between the development roller 331 and a regulating blade 334 in the development part 33.

As shown in FIG. 2 and FIG. 3, the development part 33 includes a development housing 330 (a development container), the development roller 331 (a developer carrier), a supply roller 332, an agitating paddle 333 and the regulating blade 334.

The development housing 330 contains a non-magnetic one-component developer consisting of a toner only, and the development roller 331, the supply roller 332 and the regulating blade 334 are stored in the development housing 330. The development housing 330 includes an agitating room 335 in which the developer in an agitated state is contained.

The agitating room 335 contains the non-magnetic one-component developer in an agitated state. In the agitating room 335, the agitating paddle 333 is disposed. The agitating paddle 335 agitates the developer supplied to the agitating room 335 by a toner supply device (not shown).

The development roller 331 has a rotational shaft 331*a* and a roller part 331*b*. The rotational shaft 331*a* is supported by the development housing 330 with bearings (not shown) in a rotatable manner. The roller part 331*b* is a cylindrical member provided around the outer circumferential surface of the rotational shaft 331*a*, and has a configuration that a coating layer is laminated on a surface of a base rubber (for example, silicone rubber) with an uneven coating material such as urethane. The roller part 331*b* is rotated together with the rotational shaft 331*a* with the rotation of the rotational shaft 331*a*. On the surface of the roller part 331*b*, a toner layer (a developer layer) of a predetermined thickness is formed. The thickness of the toner layer is regulated by the regulating blade 334 as described later (regulated uniformly at a predetermined thickness). The toner layer is charged by static electricity generated by contact with the regulating blade 334.

The development roller 331 is rotated in a direction from the upstream side to the downstream side (the counterclockwise direction in FIG. 2) in the rotational direction (the clockwise direction in FIG. 2) of the photosensitive drum 31 at a position facing the photosensitive drum 31. That is, the development roller 331 is rotated in the same direction as the photosensitive drum 31 at the position facing the photosensitive drum 31.

The supply roller 332 is disposed facing the development roller 331. The supply roller 332 carries the developer contained in the agitating room 335 on its outer circumferential surface. In addition, the supply roller 332 supplies the developer carried on the outer circumferential surface to the development roller 331.

The supply roller 332 is rotated in a direction from the downstream side to the upstream side (the counterclockwise direction in FIG. 2) in the rotational direction (the counterclockwise direction in FIG. 2) of the development roller 331 at a position facing the development roller 331. That is, the supply roller 332 is rotated in an opposite direction to the development roller 331 at the position facing the development roller 331.

The development roller 331 is supplied with the developer from the supply roller 332 and carries the toner layer on the outer circumferential surface. Then, the development roller 331 supplies the developer to the photosensitive drum 31. The lengths of the development roller 331 and the supply roller 332 in the axial direction (a direction perpendicular to the paper surface on which FIG. 2 is drawn) is substantially the same as the length of the photosensitive drum 31 in the axial direction. In order to efficiently move the toner from the development roller 331 to the photosensitive drum 31, a predetermined development voltage is preferably applied to the development roller 331.

In the image forming part 30, a pressing mechanism 36 including a pressing member 361 and a pressing spring 362 is disposed on the opposite side (the right lower side in FIG. 2 and the lower side in FIG. 3) to the photosensitive drum 31 with respect to the development housing 330. The pressing mechanism 36 is disposed at two positions in the longitudinal direction of the development housing 330 (positions separated from the axial center of the photosensitive drum 31 on the both sides by 85 mm respectively). When the development part 33 is attached to the image forming part 30, the pressing member 361 is pressed against the development housing 330 in a direction close to the photosensitive drum 31 (the left upper direction in FIG. 2 and the upper direction in FIG. 3), and the development roller 331 is pressed against the photosensitive drum 31 with a predetermined pressing force. In the development part 33 and the photosensitive drum 31, there is no mechanism for regulating a distance between the development roller 331 and the photosensitive drum 31, that is, a mechanism for regulating the pressing force of the development roller 331 against the photosensitive drum 31.

The regulating blade 334 is a thin metal member. The regulating blade 334 is configured such that a proximal end portion 334*a* is fixed to the development housing 330 and a distal end portion 334*b* is a free end. The regulating blade 334 comes into contact with the outer circumferential surface of the development roller 331 at a position upstream of a position where the photosensitive drum 31 and the development roller 331 face each other in the rotational direction of the development roller 331.

The regulating blade 334 is flexibly deformable, and there is a contact area (a nip area) between the regulating blade 334 and the development roller 331 in the circumferential direction of the development roller 331. The regulating blade 334 comes into contact with the outer circumferential surface of the development roller 331*b* (the roller part 331*a*) with a predetermined regulating pressure and a nip width W.

The material of the regulating blade 334 is SUS 304, and the free length of the regulating blade 334 is 10 mm. The proximal end portion 334*a* of the regulating blade 334 is subjected to a bending to form a curved part 334*c*. The curved part 334*c* comes into contact with the outer circumferential surface of the development roller 331. A radius of curvature of the curved part 334*c* is 0.1 mm or more.

Figure 4:
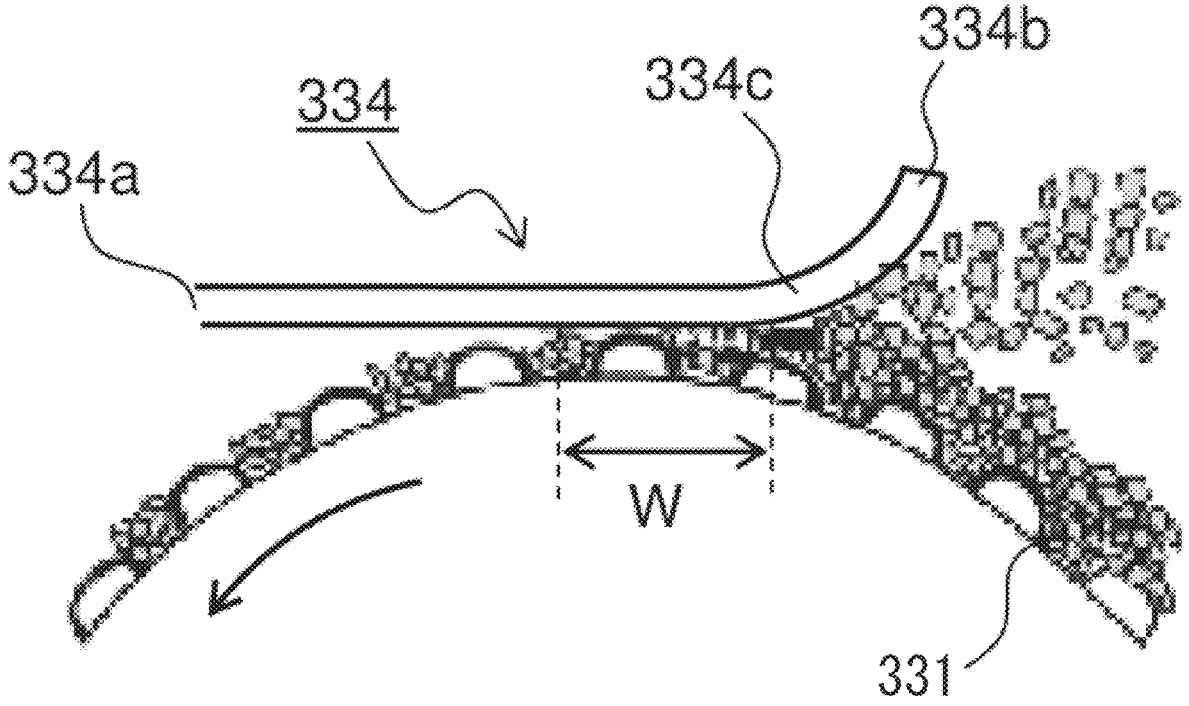
FIG. 4 is an enlarged sectional view showing a contact area between the development roller 331 and a regulating blade 334 in the development part 33.

As shown in FIG. 4, because the regulating blade 334 comes into contact with the development roller 331 with a predetermined regulating pressure (a line contact pressure), the toner layer carried on the outer circumferential surface of the development roller 331 is regulated to have a uniform thickness. Thus, the regulating blade 334 regulates an amount of the toner carried on the outer circumferential surface of the development roller 331. Further, the regulating blade 334 is rubbed against the toner carried on the outer circumferential surface of the development roller 331 to charge the toner. The linear contact pressure of the regulating blade 334 on the outer circumferential surface of the development roller 331 is a contact pressure of the regulating blade 334 per unit length at the contact area between the regulating blade 334 and the outer circumferential surface of the development roller 331.

(3. Measurement of Pressing Force of Development roller 331 to Photosensitive Drum 31) Hereinafter, a measurement method of a pressing force of the development roller 331 to the photosensitive drum 31 and a distribution of the pressing force, which are characteristic features in the image forming apparatus 100 of the present embodiment, will be described. As described above, the white void in the image and the cleaning failure are in close contact with the pressing force of the development roller 331 to the photosensitive drum 31. Specifically, when the pressing force is higher than a specified value, a cleaning electric field is excessively applied, and one dot of the image is reduced or lacked, and the white void occurs in the image. When the pressing force is lower than the specified value, the cleaning electric field is not applied sufficiently, and the cleaning failure occurs.

The proper value of the pressing force of the development roller 331 to the photosensitive drum 31 is varied depending on a state of the toner. For example, after durable use in a low temperature and low humidity environment (a L/L environment), the proper range of the pressing force is narrowed due to toner deterioration. Further, the pressing force of the development roller 331 itself is varied depending on an external temperature and humidity and a change of the outer diameter of the development roller 331 owing to durable use.

In the present embodiment, the pressing force of the development roller 331 to the photosensitive drum 31 is measured at a plurality of points in the axial direction, and it is determined whether the pressing forces are within the proper range over the entire area in the axial direction of the development roller 331. It is difficult to directly measure the pressing force during driving of the photosensitive drum 31 and the development roller 331. Therefore, the pressing force of the development roller 331 was indirectly evaluated by measuring a pulling force of a film passing through the nip area between the photosensitive drum 31 and the development roller 331. The measuring points are at least three points including the vicinities of both end portions and the center portion in the axial direction of the development roller 311.

Figure 5:
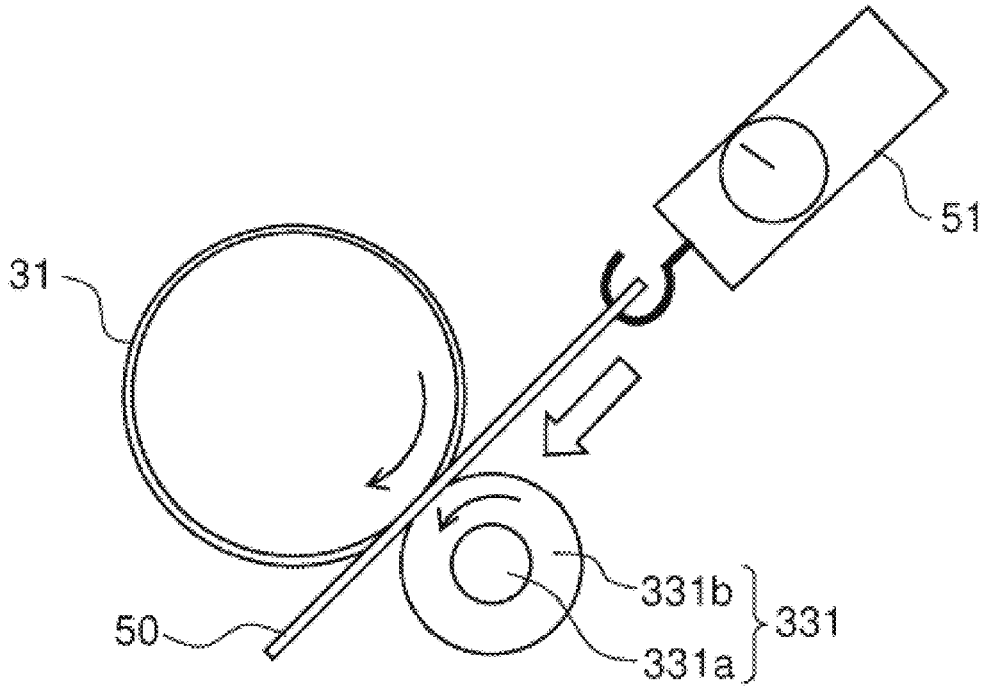
FIG. 5 is a view explaining a measurement method of a pulling force in a nip area between the photosensitive drum 31 and the development roller 331.

FIG. 5 is a view explaining a method of measuring the pulling force in the nip area between the photosensitive drum 31 and the development roller 331. As shown in FIG. 5, a PET (polyethylene terephthalate) film 50 having a width of 20 mm and a thickness of 50 μm is made to be held in the nip area. A push-pull gauge 51 is connected to an upstream side end portion of the PET film 50. In this state, the photosensitive drum 31 and the development roller 331 are rotated and then the pulling force of the PET film 50 is measured.

As the development roller 331, a roller (manufactured by NICS) having an Asker C hardness of 55° was used, which has the roller part 331*b* made of a silicone rubber layer having a layer thickness of 3.5 mm coated with urethane as a base material layer and having an outer diameter of 13 mm, an axial length of 232 mm, and a resistance value of 7.1 [log Q], and the rotational shaft 331*a* having a shaft diameter of 6 mm. A linear speed of the development roller 331 was set to 195 mm/sec. The Asker C hardness was measured using a constant pressure loader (CL-150, manufactured by Polymer Instruments Inc.). The resistance value was measured by bringing the development roller 331 into contact with a metal roller, rotating it, and applying a DC voltage of 100 V.

As the photosensitive drum 31, a positively charged single-layer OPC photosensitive drum (manufactured by Kyocera Document Solutions) having an outer diameter of 24 mm and a photosensitive layer thickness of 22 μm was used. The results are shown in FIG. 6 and FIG. 7.

Figure 6:
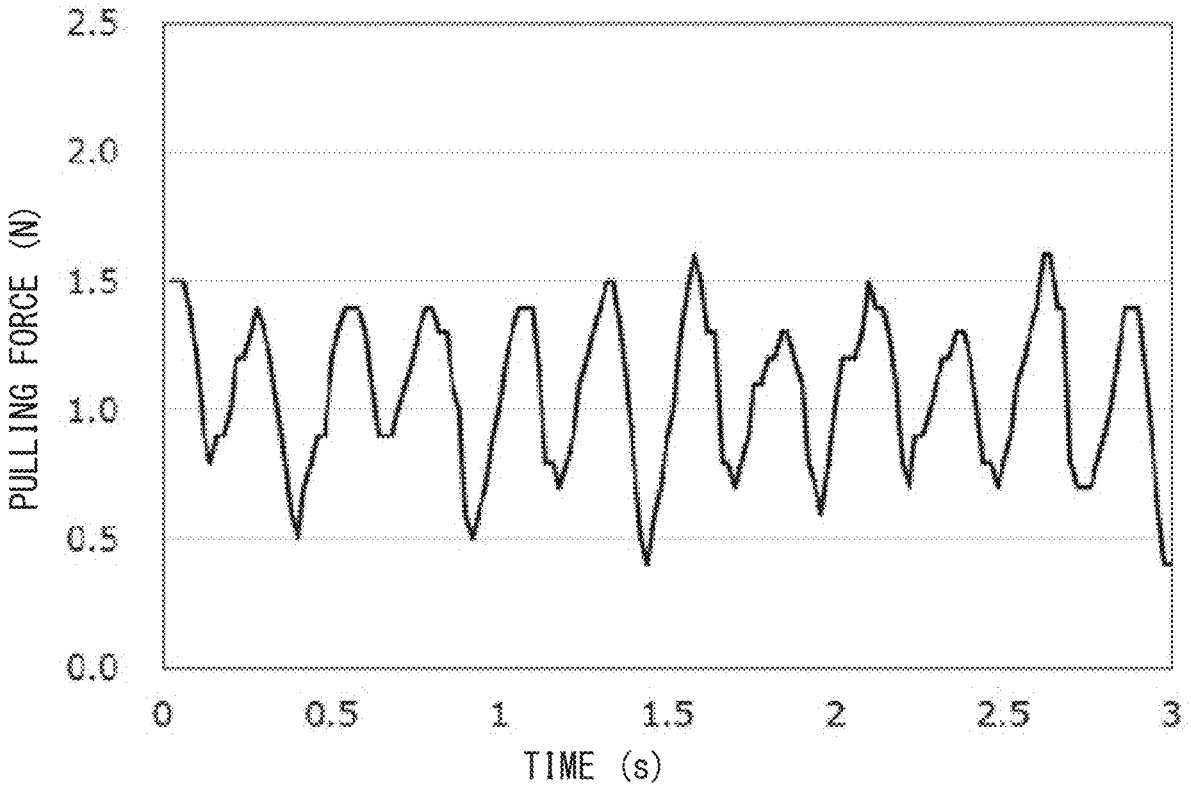
FIG. 6 is a graph showing a measurement result of the pulling force by the method shown in FIG. 5.

FIG. 6 is a graph showing the measurement result of the pulling force. FIG. 7 is a graph showing a distribution of the pulling force in the axial direction of the development roller 331. As shown in FIG. 6, the measured value has a ripple (a degree in variation) with respect to time, so the maximum value is plotted in FIG. 7. Hereinafter, a distribution of the pulling force with respect to the axial position of the development roller 331 shown in FIG. 7 is referred to as the "a pressing force distribution" in the present specification.

Figure 7:
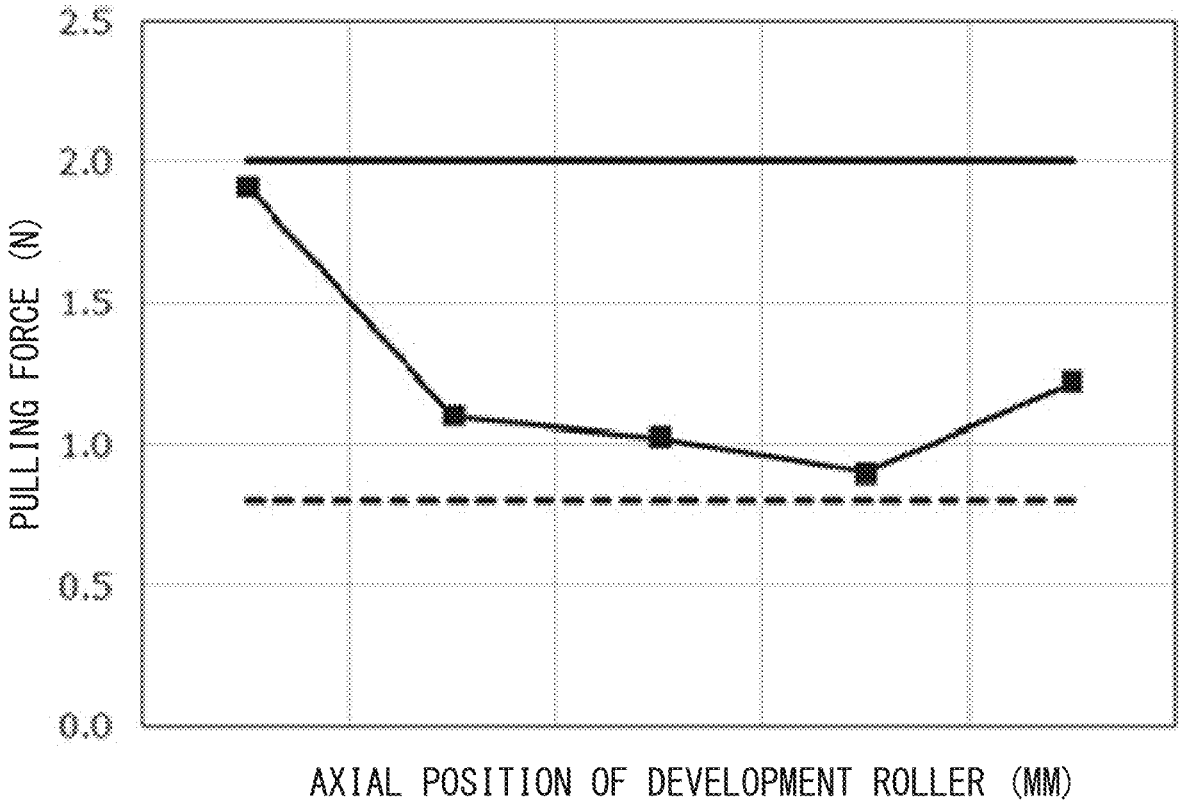
FIG. 7 is a graph showing a distribution of a pulling force in an axial direction of the development roller 331.

The proper range shown in FIG. 7 is set such that an upper limit value (=2.0 N, shown by the solid line) of the pressing force, at which an image density is insufficient and the white void occurs in the half-tone image, and a lower limit value (=0.8 N, shown by the broken line) of the pressing force, at which the remaining toner on the photosensitive drum 31 is not collected and the cleaning failure occurs, are previously set based on the measured data.

The method for setting the upper limit value of the pressing force is as follows. A 25% half-tone image was printed one by one while changing a spring load of the pressing spring 362, an image density (ID) of the image was measured using an image density meter (an ID measurement instrument), and the spring load (N) when a difference ΔID between the maximum value and the minimum value of the image density became larger than 0.2 was set as the upper limit value.

The method for setting the lower limit value of the pressing force is as follows. A solid patch image of 20 mm×20 mm was formed at 3 positions including the center, the left and the right in the axial direction of the development roller 331 while changing a spring load of the pressing spring 362, and then transferred to the sheet. After the image is transferred on the sheet, the spring load (N) when the toner adhesion was observed on the sheet at the position where the photosensitive drum 31 was rotated by one rotation was set as the lower limit value.

Next, setting of the proper range of the variation width of the pulling force (the pressing force) will be described. In the setting method, a 25% half-tone image was printed using the same test apparatus as described above, and conveyance forces (the pulling forces) of the PET film on the driving side, the center side, and the counter driving side in the axial direction of the development roller 331 when the white void did not occur were profiled, and then the variation width of the pulling force was obtained. Whether the white void occurs was determined as follows. An image density (ID) of the image was measured with an image density meter (an ID measurement instrument), and then when a difference ΔID between the maximum value and the minimum value of the measured image density was less than 0.2, it was determined that the white void did not occur. The results are shown in Table 1.

TABLE 1

| TEST No. | ENVIRONMENTAL CONDITION | PULLING FORCE (N) DRIVING SIDE | CENTRAL SIDE | COUNTER DRIVING SIDE | AVARAGE VALUE (X) | MAX VARIATION RATE | MIN VARIATION RATE |
|---|---|---|---|---|---|---|---|
| 1 | HH※ | 2.1 | 1 | 1 | 1.55 | 1.35 | 0.65 |
| 2 | HH | 2.4 | 0.8 | 1 | 1.6 | 1.50 | 0.50 |
| 3 | RR | 1.3 | 1.3 | 1.2 | 1.25 | 1.04 | 0.96 |
| 4 | LL | 2.4 | 0.9 | 1.1 | 1.65 | 1.45 | 0.55 |
| 5 | RR | 1.7 | 0.8 | 1.2 | 1.25 | 1.36 | 0.64 |
| 6 | RR | 1.9 | 0.9 | 1.2 | 1.4 | 1.36 | 0.64 |
| 7 | HH | 1.6 | 0.8 | 1.1 | 1.2 | 1.33 | 0.67 |
| 8 | LL | 1.5 | 0.7 | 0.8 | 1.1 | 1.36 | 0.54 |
| 8 | RR | 0.9 | 1.1 | 1.6 | 1.25 | 1.28 | 0 72 |
| 10 | RR | 1.2 | 1.2 | 1.6 | 1.4 | 1.14 | 0.86 |
| 11 | RR | 0.9 | 1.1 | 1.5 | 1.2 | 1.25 | 0.75 |

※Durability

In Table 1, "HH" indicates a high temperature and high humidity condition (28° C., 80%), "RR" indicates a normal temperature and normal humidity condition (23° C., 50%), and "LL" indicates a low temperature and low humidity condition (10° C., 15%). When the maximum value (N) and the minimum value (N) of the pulling forces on each of the driving side, the center side and the counter driving side are respectively indicated as MAX and as MIN, the average value X is expressed by X=(MAX-MIN)/2.

As shown in Table 1, when the white void did not occur, a MAX variation rate (MAX/X) was within the range of 1.04 to 1.50. Similarly, a MIN variation rate (MIN/X) was within the range of 0.50 to 0.96.

As described above, when the conveyance force of the PET film is profiled in the axial direction of the development roller 331, by adjusting the pressing force distribution such that the variation widths of MAX and MIN satisfy the following inequalities (1) and (2), the pressing force can be kept within the proper range over the entire area in the axial direction of the development roller 331.

$$X \leq \mathrm{MAX} \leq 1.5X \quad (1), \text{ and}$$

$$0.5X \leq \mathrm{MIN} \leq X \quad (2).$$

As shown in FIG. 7, the pressing force distribution is not symmetrical, and the pressing force on the driving side (the left side in FIG. 7) of the development roller 331 is higher than the pressing force on the counter driving side (the right side in FIG. 7). Thus, by making the spring load of the pressing spring 362 disposed on the driving side larger than the spring load of the pressing spring 362 disposed on the counter driving side, for example, by setting the spring load of the pressing spring disposed on the driving side to 7 to 9 N and setting the spring load of the pressing spring 362 disposed on the counter driving to 4 to 6 N, it becomes possible to make the pressing force distribution axially symmetric.

This is because, even if the spring load of the pressing spring 362 is increased, the maximum value of the pulling force (the pressing force) is not higher than 2.0 N, and the ripple (the variation in the pressing force with respect to the rotating time) at measuring the pulling force can be suppressed. As a result, a variation of the plotted values of the pulling force in FIG. 7 is suppressed, and the pressing force distribution can be set to within the proper range.

Further, the pressing force at the central portion in the axial direction of the development roller 331 is lower than that at both the end portions. This is because the central portion of the development roller 331 bends with time as the pressing state with the photosensitive drum 31 continues. Therefore, by providing the roller part 331*b* of the development roller 331 with a crown shape of 100 μm or less (a shape that the thickness of the central portion in the axial direction of the roller part 331*b* is increased), the pressing force at the central portion in the axial direction of the development roller 331 can be increased, and the variation width of the pressing force distribution can be decreased.

The configuration of the development part 33 shown in FIG. 2 and FIG. 3 has a merit that the degree of freedom is large in the stage of development and design, but has a demerit that the shape of the pressing force distribution is easily to change due to a cumulative driving time of the development part 33 and a change of the outside temperature and humidity. If the pressing force distribution is disordered and extends outside the proper range, as described above, the white void in the image and the cleaning failure occur. Therefore, it is necessary to measure the pressing force distribution at the time of manufacturing of the image forming apparatus 1 and to design the image forming apparatus 1 such that there is no variation in the pressing force distribution due to noise caused by environmental variation or durable printing at use.

Conventionally, in the development roller 331 having a high hardness such that the nip width is 2 mm or less, the nip pressure increases and the contour of the dot image tends to become unclear. This disadvantage is caused by the fact that the toner adheres to the non-exposed area on the photosensitive drum 31 corresponding to the white background area (the margin area) and is not collected by the development roller 331, or that the toner once developed to a predetermined area on the photosensitive drum 31 is shifted in the development nip area. Therefore, the above-described problem can be prevented by increasing the collection electric field (V0−Vdc) from the photosensitive drum 31 to the development roller 331.

Specifically, by setting the development voltage Vdc, the surface potential V0, and the surface potential VL after exposure within the ranges represented by the following inequalities (3) and (4), and setting the collection electric field (V0−Vdc) to 2 times or more of the development electric field (Vdc−VL) and the development electric field (Vdc−VL) to 100 V or more, it is possible to obtain a clear dot image in the nip width of 550 to 700 μm.

$$V0-Vdc \geq 2(Vdc-VL) \quad (3), \text{ and}$$

$$Vdc-VL \geq 100 \quad (4).$$

Figure 8:
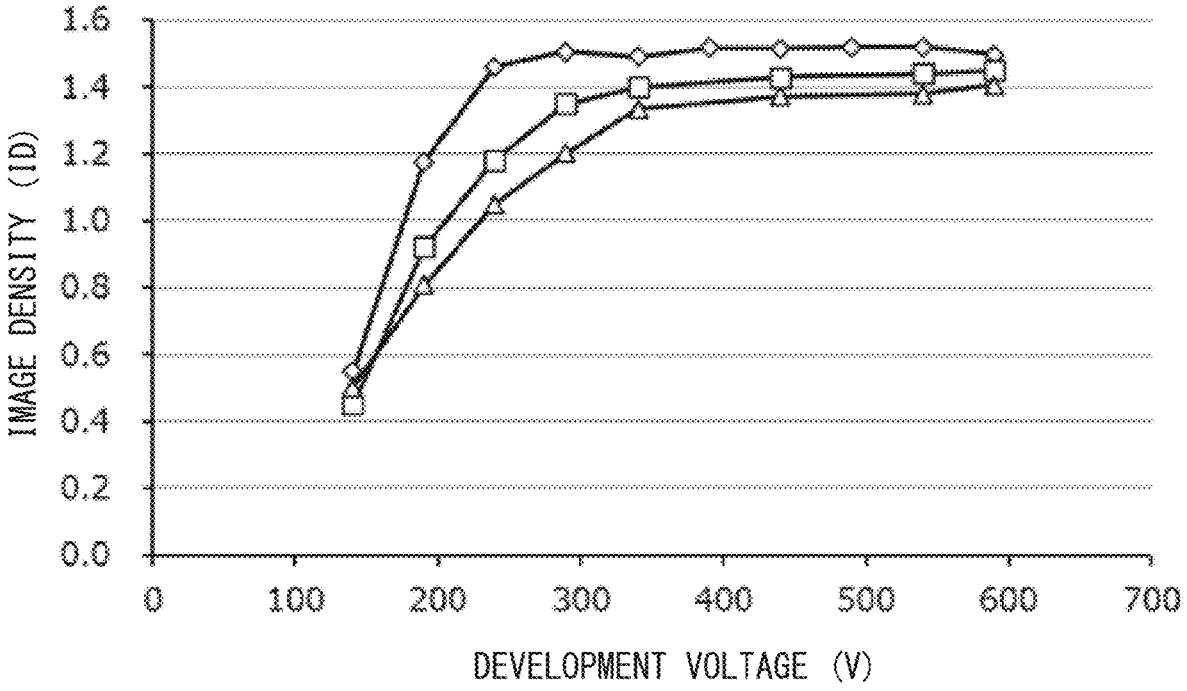
FIG. 8 is a graph showing a relationship between a development voltage applied to the development roller 331 and an image density when a surface free energy of the development roller 331 is changed.

(4. Another Structure) FIG. 8 is a graph showing a relationship between a development voltage applied to the development roller 331 and an image density (ID) when a surface free energy of the development roller 331 is changed. The surface free energy corresponds to a surface tension of a liquid in a solid, and corresponds to a molecular energy of the surface of the solid. In FIG. 8, a case where the surface free energy of the development roller 331 is 12 $mJ/m^2$ is represented by the data series of ◇, a case where the surface free energy is 21 $mJ/m^2$ is represented by the data series of □, and a case where the surface free energy is 30 $mJ/m^2$ is represented by the data series of Δ.

As shown in FIG. 8, a usable range OW of the development voltage tends to become narrower as the surface free energy of the development roller 331 increases. This is because, as the surface free energy of the development roller 331 increases, the upper limit value of the pressing force of the development roller 331, at which the white void occurs in the half-tone image, decreases. The surface free energy of the development roller 331 is preferably 5 $mj/m^2$ or more and 27 $mj/m^2$ or less.

An amount of the toner regulated by the regulating blade 334 also varies depending on a contact area ratio of the outer circumferential surface of the development roller 331. The contact area ratio of the outer circumferential surface of the development roller 331 is a ratio of the area of the outer circumferential surface of the development roller 331 excluding the concave area (the non-contact area) to the area of the outer circumferential surface of the development roller 331. That is, the contact area ratio of the outer circumferential surface of the development roller 331 shows a true contact area with respect to an apparent contact area between the outer circumferential surface of the development roller 331 and the regulating blade 334. The contact area ratio is preferably 4.5 to 10%, and more preferably 6 to 8%.

A regulating pressure of the regulating blade 334 is preferably 10 to 60 N/m, and more preferably 15 to 25 N/m. The producing method of the development roller 331 is not particularly limited, and the surface roughness of the development roller 331 may be adjusted by coating a coating layer containing particles or may be adjusted only by polishing.

In the present embodiment, both the toner (the pulverized toner) produced by a pulverizing method and the toner (the polymerized toner) produced by a polymerization method can also be used. The polymerized toner has a low adhesion force because of its true spherical shape having a high circularity, and has the larger usable range OW because of a good development performance. Therefore, the present disclosure is particularly effective in the non-magnetic one-component development system using the pulverized toner, which is more inexpensive than the polymerized toner.

In the present embodiment, it is confirmed that a preferable result can be obtained when the toner has the central particle diameter of 6.0 to 8.0 μm. The reason for selecting the range of the central particle diameter is that the central particle diameter smaller than 6.0 μm leads to an increase in the producing cost of the toner, and the central particle diameter larger than 8.0 μm increases the toner consumption amount and deteriorates the fixing performance, which is undesirable.

In the present embodiment, it is confirmed that a preferable result can be obtained when the toner has the circularity of 0.93 to 0.97. When the circularity is 0.93 or less, the image quality tends to deteriorate. When the circularity is 0.97 or more, the producing cost is significantly increased. Therefore, the both cases are not preferable.

Further, in the present embodiment, it is confirmed that a preferable result can be obtained when the toner has the melt viscosity of 100,000 Pa·s or less at 90° C. When the melt viscosity at 90° C. is 100,000 Pa·s or more, the fixing performance of the toner deteriorates, which is undesirable from the viewpoint of energy saving.

It is also confirmed that a similar result can be obtained when a linear velocity difference between the photosensitive drum 31 and the development roller 331 is 1.1 to 1.6 (the surface velocity of the development roller 331 is higher than that of the photosensitive drum 31). If the linear velocity difference is smaller than 1.1, fogging, in which the toner adheres to the white ground area, occurs, which is not preferable. On the other hand, if the linear velocity difference is 1.6 or more, a driving torque and vibration of the development part 33 and the mechanical stress of the toner increase, which is not preferable from the viewpoint of the lifetime of the device.

Further, it is confirmed that a similar result can be obtained when the surface potential V0 of the photosensitive drum 31 is 500 to 800 V and the surface potential VL after exposure is 70 to 200 V.

In addition, the present disclosure is not limited to the above embodiments, and various modifications can be made without departing from the spirit of the present disclosure. For example, although the monochrome printer has been described as an example of the image forming apparatus 1 in the above embodiment, it can also be applied to a tandem type or a rotary type color printer, for example. The present invention is also applicable to an image forming apparatus such as a copy machine, a facsimile machine, or a multi-function peripheral having these functions. However, they need to be provided with the photosensitive drum 31 and the development part 33 of the non-magnetic one-component development system.

Although the photosensitive drum 31 in the above embodiment uses a cylindrical raw tube as a support, a support of another shape may be used. The other shape may contain a plate shape or an endless belt shape. Further, although amorphous silicon is used as the photosensitive layer of the photosensitive drum 31 in the above embodiment, for example, the photosensitive drum may have a charge injection blocking layer for blocking injection of charges from the support.

The present disclosure is applicable to an image forming apparatus provided with a development device of a non-magnetic one-component development type using a non-magnetic toner. By utilizing the present disclosure, it is possible to provide the image forming apparatus capable of effectively suppressing the white void in the image and the cleaning failure in the non-magnetic one-component development type.

The invention claimed is:

1. An image forming apparatus comprising:

a rotatable image carrier having a surface on which a photosensitive layer is formed;

a charger which charges the image carrier at a predetermined surface potential;

an exposure device which exposes the surface of the image carrier charged by the charger and attenuates the surface potential to form an electrostatic latent image;

a development device including a development container, a developer carrier and a regulating blade, in which the development container contains a non-magnetic one-component developer consisting of a toner only, the developer carrier includes a roller part which carries the toner on an outer circumferential surface and a rotational shaft disposed along an axial center of the roller part, and is pressed on the image carrier with a predetermined pressing force to form a nip area between the roller part and the image carrier, the regulating blade comes into contact with the outer circumferential surface of the roller part of the developer carrier to regulate a thickness of a toner layer formed on the outer circumferential surface of the roller part, and the development device is configured to supply the toner to the image carrier on which the electrostatic latent image is formed; and a pressing mechanism which presses the development container close to the image carrier, wherein when the developer carrier and the image carrier are rotated in a state where a polyethylene terephthalate film having a width of 20 mm and a thickness of 50 μm is held in the nip area and then a pulling force of the film is measured at a plurality of positions in an axial direction of the nip area on an upstream side of the nip area in a rotational direction of the image carrier, a maximum value MAX of the pulling force, a minimum value MIN of the pulling force, and an average value X=(MAX−MIN)/2 of the pulling force satisfy the following expressions (1) and (2), and when a development voltage applied to the developer carrier is set to Vdc, the surface potential of the image carrier is set to V0, and the surface potential of the image carrier after exposure is set to VL, the following expressions (3) and (4) are satisfied:

$$X \leq \mathrm{MAX} \leq 1.5X \quad (1),$$

$$0.5X \leq \mathrm{MIN} \leq X \quad (2),$$

$$V0 - Vdc \geq 2(Vdc - VL) \quad (3) \text{ and}$$

$$Vdc - VL \geq 100 \quad (4).$$

2. The image forming apparatus according to claim 1, wherein, the pressing mechanism includes a pair of pressing members coming into contact with the development container at two positions in a longitudinal direction of the development container, and a pair of pressing springs biasing the pressing members toward the development container, and a spring load of the pressing spring disposed on a driving side of the developer carrier is larger than a spring load of the pressing spring disposed on a counter driving side of the developer carrier.

3. The image forming apparatus according to claim 1, wherein, the roller part of the developer carrier has a crown shape, and a difference between a diameter of an axial center portion and a diameter of an axial end portion of the roller part is 100 μm or less.

4. The image forming apparatus according to claim 1, wherein the developer carrier has a free surface energy of 5 $mj/mm^2$ or more to 27 $mj/mm^2$ or less.

5. The image forming apparatus according to claim 1, wherein the toner is a pulverized toner produced by a pulverizing method.

6. The image forming apparatus according to claim 1, wherein the toner has a central particle diameter of 6.0 to 8.0 μm.

7. The image forming apparatus according to claim 1, wherein the toner has a circularity of 0.93 to 0.97.

8. The image forming apparatus according to claim 1, wherein the toner has a melt viscosity of 100,000 Pa·s or less at 90° C.

9. The image forming apparatus according to claim 1, wherein the image carrier and the developer carrier are rotated in the same direction at the nip area.

10. The image forming apparatus according to claim 1, wherein a liner speed difference between the image carrier and the developer carrier is 1.1 to 1.6.

* * * * *